United States Patent [19]

Rhoton

[11] 3,958,783

[45] May 15, 1976

[54] VEHICLE ZERO SPEED DETECTION SYSTEM

[75] Inventor: Richard S. Rhoton, Monroeville, Pa.

[73] Assignee: Westinghouse Electric Corporation, Pittsburgh, Pa.

[22] Filed: Sept. 9, 1974

[21] Appl. No.: 504,406

Related U.S. Application Data

[63] Continuation of Ser. No. 370,490, June 15, 1973, abandoned.

[52] U.S. Cl. ..... 246/182; 246/167 R

[51] Int. Cl.[2] ..... B61L 3/00

[58] Field of Search..... 246/167 R, 187 B, 182 B, 246/182 C, 34 R

[56] References Cited

UNITED STATES PATENTS

| | | | |
|---|---|---|---|
| 3,229,086 | 1/1966 | Allison | 246/187 B |
| 3,334,224 | 8/1967 | Allen | 246/187 B |
| 3,349,303 | 10/1967 | Burnight | 246/187 B |
| 3,727,046 | 4/1973 | Woods | 246/182 C |
| 3,728,539 | 4/1973 | Thorne-Booth | 246/182 B |

*Primary Examiner*—Trygve M. Blix
*Assistant Examiner*—Reinhard J. Eisenzopf
*Attorney, Agent, or Firm*—R. G. Brodahl

[57] ABSTRACT

A signal transmitter provides an oscillatory signal to an antenna situated along a vehicle stopping area. The antenna has incremental transpositions along its length for reversing the phase of the magnetic field produced at each transposition in response to the provision of the oscillatory signal. Signal receiving means on a vehicle sense the phase reversals of the magnetic field, and when the phase reversals are sensed at a rate proportional to a defined zero speed of the vehicle, at least one door on the vehicle is opened.

18 Claims, 18 Drawing Figures

VEHICLE ZERO SPEED DETECTION SYSTEM

CROSS REFERENCE TO RELATED APPLICATIONS

The present application is a continuation of an earlier filed application Ser. No. 370,490, filed June 15, 1973, now abandoned, and assigned to the same assignee.

Reference is made to patent application Ser. No. 132,379, filed Apr. 8, 1971, entitled "Method and Apparatus For Providing Vehicle Control Signal" on behalf of George M. Thorne-Booth, now issued as U.S. Pat. No. 3,728,539 and which is assigned to the assignee of the present invention.

BACKGROUND OF THE INVENTION

In any vehicle control system there is a need to know when a vehicle has arrived within a vehicle stopping area, as well as determining when the vehicle has reached a defined zero speed such that the doors on the vehicle may be safely opened. In a known prior art system a signal is transmitted from the wayside along the vehicle stopping area informing the vehicle that the vehicle is within the vehicle stopping area. A tachometer or the like is included on the vehicle for sensing when the vehicle has reached the defined zero speed. The doors on the vehicle are opened in response to the concurrent provision of these two signals.

According to the teachings of the present invention, the vehicle senses its presence within the vehicle stopping area and the zero speed condition in response to the provision of signals from the wayside at the vehicle stopping area, thereby removing the need of a tachometer which is difficult to align properly to accurately sense the zero speed condition.

SUMMARY OF THE INVENTION

In a vehicle control system, there is included a vehicle stopping area. There are signal transmitting means located along the vehicle stopping area for transmitting a signal which reverses phase at spaced increments along the vehicle stopping area. Signal receiving means on the vehicle sense the transmitted signal phase reversals at a rate determined by the rate of travel of the vehicle, and included are means for providing a control signal indicative of said vehicle having reached at least a selected speed when the received signal is received at a given rate.

DESCRIPTION OF THE PREFERRED EMBODIMENT

Figure 1:
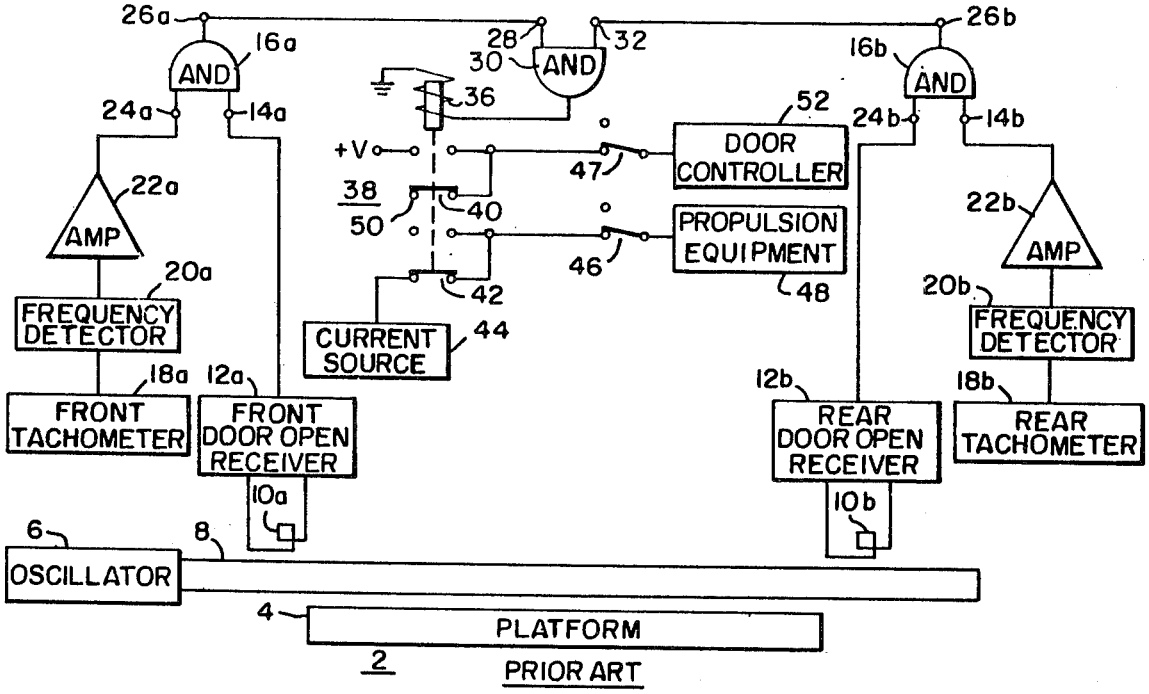
PRIOR ART FIG. 1
FIG. 1 is a schematic and block diagram representation of a zero speed detection system known in the prior art.

FIG. 1 illustrates a known vehicle zero speed detection and door opening system. A vehicle responds to a signal transmission from a vehicle stopping area such as a station and a zero speed indication from a tachometer or the like mounted on the vehicle to determine when the vehicle is within the station area and has reached a defined zero speed such that the doors on the vehicle may be safely opened. A vehicle stopping area 2 includes a platform 4 at which the vehicle is to stop. A signal transmitting means such as an oscillator 6 couples an oscillatory signal to an antenna 8 which extends the length of the vehicle stopping area. A vehicle (not shown) includes like apparatus on both sides of the vehicle for sensing the magnetic field produced by the signals transmitted along the vehicle stopping area. Therefore, signal receiving apparatus for only one side of the vehicle is illustrated and described, and it is to be appreciated that only the doors on the one side of the vehicle are opened in response to the detection of the magnetic field signal from the vehicle stopping area, and the zero speed indication from the tachometer. An antenna 10*a* on the front of the vehicle couples with the antenna 8 to sense the magnetic field signal. A front door open receiver 12*a* responds to the magnetic field signal input and converts same to a direct current (dc) signal which is suitable for enabling an AND gate. The dc signal is coupled to a first input terminal 14*a* of an AND gate 16*a* and is indicative of at least the front end of the vehicle being present within the vehicle stopping area. A front tachometer 18*a* which is mounted on the vehicle senses the speed of travel of the vehicle in a well-known manner. A frequency detector 20*a* is responsive to the signal output from the tachometer and provides a dc signal when the frequency or the amplitude of the signal from the tachometer is at or below the defined frequency or amplitude indicative of zero speed, to a buffer amplifier 22*a* which provides a suitable dc signal to an input terminal 24*a* of the AND gate 16*a*. In response to the dc signals at the respective input terminals, the AND gate 16*a* provides a dc signal at its output terminal 26*a* which is indicative of the front of the vehicle being present within the vehicle stopping area, and that the front of the vehicle has reached the defined zero speed rate. This dc signal is applied to a first input terminal 28 of an AND gate 30.

Apparatus having the same numerical designation with the letter *b* appended thereto for like apparatus is included on the rear of the vehicle. When the apparatus on the rear of the vehicle senses that the vehicle is present within the vehicle stopping area, and that the vehicle has reached the defined zero speed rate of travel a dc signal is provided at the output terminal 26*b* of the AND gate 16*b* and is coupled to a second input terminal 32 of the AND gate 30.

In response to the dc signals at the terminals 28 and 32, which are indicative of the front and rear of the vehicle being within the vehicle stopping area, and the vehicle having reached zero speed, the AND gate 30 provides a dc signal output for energizing a coil 36 of a relay 38. Prior to the energization of the relay 38 the contacts 40 and 42 are in the position illustrated. A current source 44 provides a propulsion signal or current to the propulsion equipment 48 of the vehicle by way of relay contacts 42 and 46, for permitting the vehicle to continue to travel along the vehicle travel path. The doors on the one side of the vehicle are not open at this time since the contact 50 has no power applied thereto and therefore the door controller 52 is not energized. In response to the energization of the relay 38 the contacts 40 and 42 are pulled up and the propulsion equipment 48 no longer receives a propulsion signal and therefore ceases tractive effort. A positive voltage +V is coupled to the door controller 52 by way of relay contacts 40 and 47 for opening the doors on the one side of the vehicle. Door controllers are well known in the art and may take many different forms, and therefore a detailed description of their operation is omitted. The relay contacts 46 and 47 may be relay contacts of a relay on the other side of the vehicle which performs the same function as the relay 38 for the one side of the vehicle. This assures that the doors on both sides of the vehicle are not opened at the same time since the contacts 46 and 47 are shown in the deenergized position. It is seen, therefore, that for the system shown that the vehicle concurrently responds to wayside transmissions from the vehicle stopping area, and zero speed indications from tachometers on the vehicle to ascertain that the vehicle is within the vehicle stopping area and has reached a defined zero speed. Tachometers are difficult to align and are susceptible to noise problems such that circumstances may occur when zero speed is ascertained in a non-safe or inaccurate manner.

Figure 2:
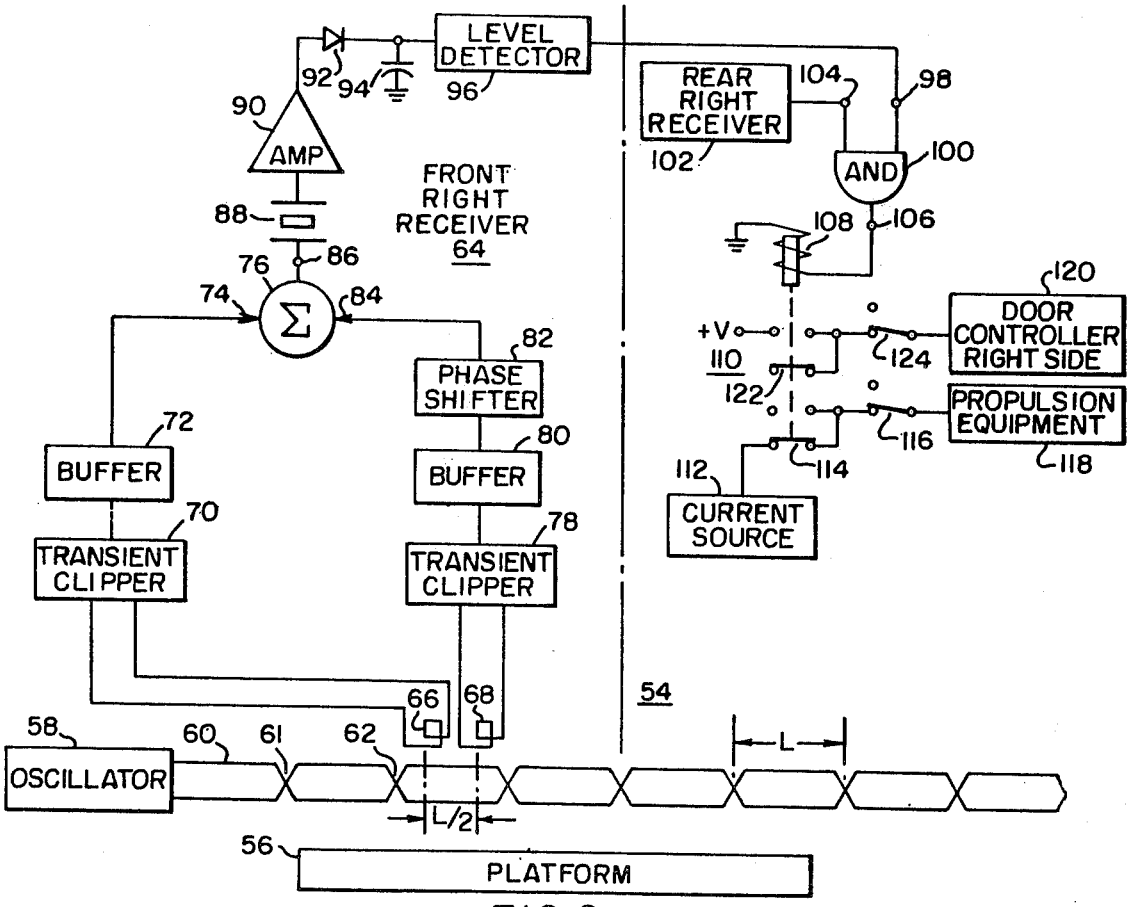
FIG. 2 is a schematic and block diagram representation of a zero speed detection system according to the teachings of the present invention.
Figures 3A, 3B, 3C, 4A, 4B, 4C, 4D:
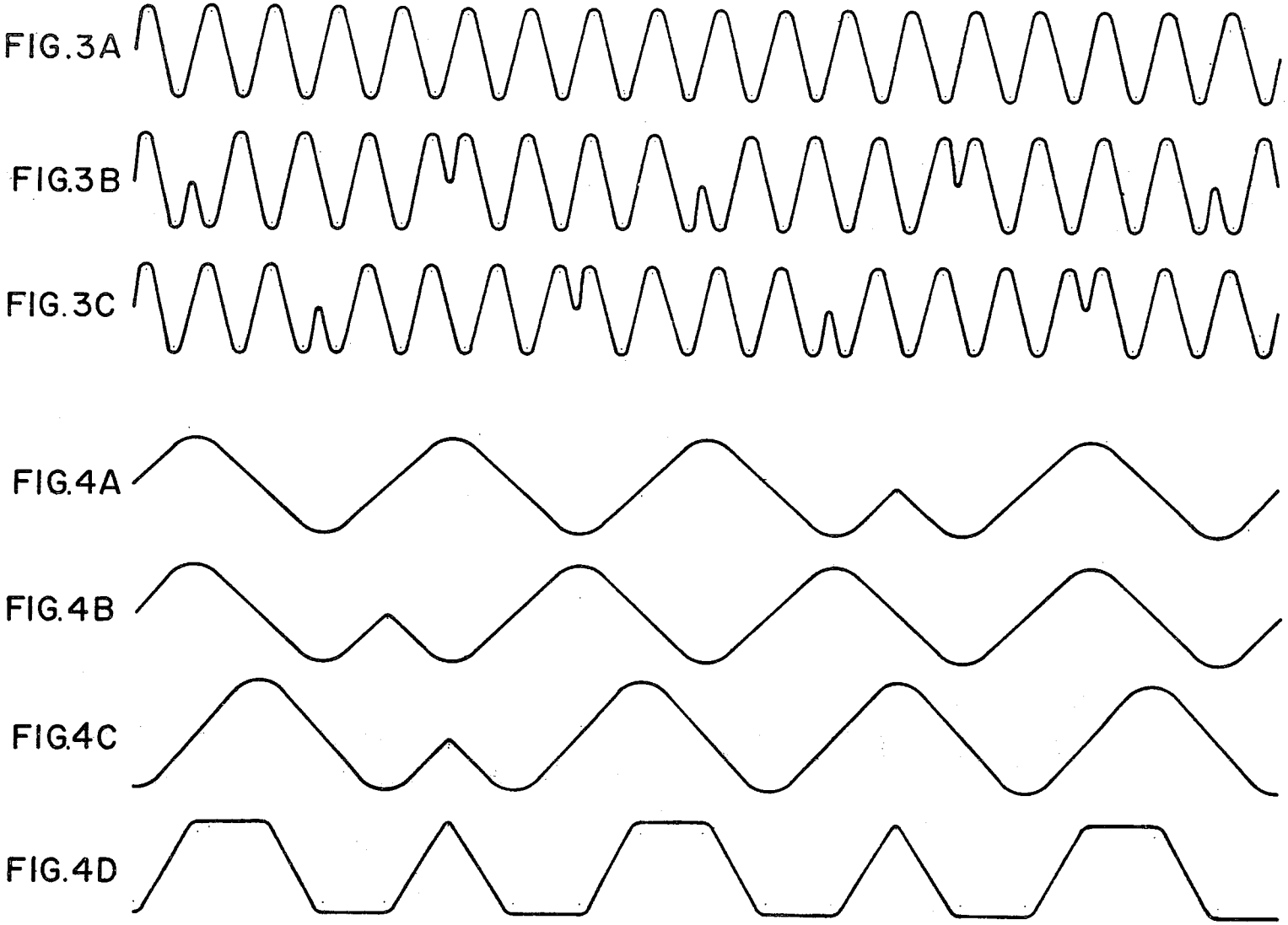
FIGS. 3A through 3C are waveform relationship diagrams which are helpful in the understanding of FIG. 2.
FIGS. 4A through 4D are wave shape relationship diagrams which are helpful in the understanding of FIG. 2.

FIG. 2 illustrates a vehicle zero speed detection and door control system which obviates the need of tachometers for detecting zero speed. The system responds only to signal transmissions from the vehicle stopping area for ascertaining that the vehicle is within the vehicle stopping area and has reached the defined zero speed. A vehicle travel path includes a vehicle stopping area 54 which may comprise a platform 56 at which a vehicle (not shown) is to stop. A signal transmitting means such as an oscillator 58 provides an oscillatory signal input to a means for shifting the phase of the magnetic field produced in response to the oscillatory signal, at spaced increments or fixed positions along the vehicle travel path. The means for shifting the phase of the magnetic field produced in response to the oscillatory signal may, for example, take the form of an antenna 60 which has spaced transpositions along its length for shifting the phase of the magnetic field produced in response to the oscillatory signal at each such transposition, such as transpositions 61 and 62 and so on along the length of the antenna. The incremental spacing between transposition intervals is an increment L, where L for example may be 12 inches in length. The signal output from the oscillator 58 is illustrated in FIG. 3A.

A signal receiving system 64 for the front right side of the vehicle is illustrated. It is to be appreciated that like apparatus is included for the rear right portion of the vehicle, as well as for the front and rear portions of the left side of the vehicle. The functioning of the front right receiver will be described in detail only, as the other receivers function in a like manner. Antennas 66 and 68 mounted on the right front of the vehicle are spaced an incremental distance L/2 apart for coupling with the antenna 60. The distance or increment L/2 for purposes of explanation is to be 6 inches. The incremental spacing between the antennas 66 and 68 may be other than 6 inches, as long as the spacing is not an even multiple of L. Since the incremental spacing between the antennas 66 and 68, for the purpose of description, is chosen to be 6 inches it follows that when the antenna 66 is over a transposition point such as the point 62 it senses a phase reversal in the magnetic field, whereas the antenna 68 is substantially at the midpoint between transpositions, and does not sense a phase reversal in the magnetic field. It follows that a shift in phase is alternately sensed by the respective antennas every 6 inches. The signal sensed by the antenna 66 is illustrated by FIG. 3B and the signal sensed by the antenna 68 is illustrated by FIG. 3C.

Returning to FIG. 2, two signal receiving channels are included in the receiver 64 to guarantee that there is always a signal input sensed even if one of the antennas is situated over a null point, for example the null point 62, such as occurs at each transposition point. This, as is to be explained shortly, is accomplished by the use of a phase shift in one of the receiving channels. The signal sensed by the antenna 66 is coupled to a transient clipper 70, for removing noise signals, and from there to a buffer amplifier 72 which provides isolation. The signal output from the buffer amplifier 72 (see FIG. 4A) is provided to a first input 74 of a signal comparison means such as the signal summation device 76. The signal sensed by the antenna 68 is coupled to a transient clipper 78, and from there to a buffer amplifier 80 and to the input (see FIG. 4B) of a phase shifting network 82 which shifts the signal a predetermined angular amount, which for purposes of explanation only will be chosen to be 90° (see FIG. 4C). The signal at the output terminal 86 of the summation device (see FIG. 4D) is applied to the input of a frequency selective and pahse sensitive device such as the high Q, narrow band crystal filter 88.

Figure 7:
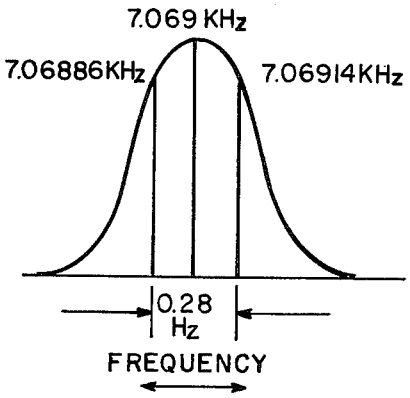
FIGS. 7 and 8 are characteristic diagrams which are helpful in the understanding of the frequency and phase characteristics of the system illustrated in FIG. 2.

For purposes of description the signal output from the oscillator 58 is chosen to be at a frequency of 7.069 kilohertz (khz). If the oscillator is accurate to plus or minus 0.14 Hertz, a frequency spectrum for the oscillator 58 is as illustrated in FIG. 7, where it is shown that the bandwidth of the oscillator is 0.28 Hertz. Therefore, the crystal 88 is chosen to have a bandwidth of 0.28 Hertz. As is known in the art the product of the bandwidth and rise time for such a crystal is approximated by the following equation:

$$BwRt = 0.35$$

where $Bw$ is the bandwidth and $Rt$ is the rise time, therefor $$Rt = 0.35/0.28 = 1.25 \text{ seconds}$$

Figure 8:
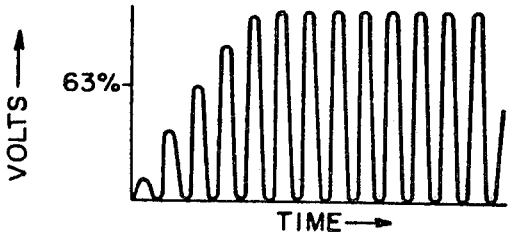

It is seen therefore that the rise time for this particular crystal is 1.25 seconds. That is, the time required for the crystal to build up to an approximate 63% level of its maximum signal output is 1.25 seconds. For the system shown therefor, the vehicle must travel 6 inches, the increment between sensed phase reversals of the received signals, in 1.25 seconds or a longer time interval in order that the crystal provides the required signal output. That is the vehicle must be at a speed of approximately 0.27 miles per hour or less for 1.25 seconds, which for purposes of description is the defined zero speed for the disclosed system. This is well below the railroad industry standard of defined zero speed which is a speed of less than 1 mile per hour for 1 second. The required rise time characteristic for the crystal is illustrated by FIG. 8.

It is seen therefore that when the vehicle is traveling at a relatively high rate of speed, the phase reversals at each 6 inch increment are sensed at a relatively high rate and therefore the crystal cannot provide a maximum signal output in the short time duration between sensed phase reversals. When, however, the vehicle travels at a lower speed, the crystal has more time to build up to at least the 63% level and provide a higher signal amplitude output. The signal output from the crystal is amplified by an amplifier 90, detected by a detector, such as the diode 92, and the detected signal charges a charge storage device such as the capacitor 94. A level detector 96 provides a signal output to an input terminal 98 and of an AND gate 100 only when the capacitor 94 has charged to a predetermined voltage level which is proportional to the signal output from the crystal 88 when the crystal has had the approximate 1.25 second time between sensed phase reversals to build up to its 63% or greater signal level.

Figures 5A, 5B, 5C, 5D, 5E, 5F:
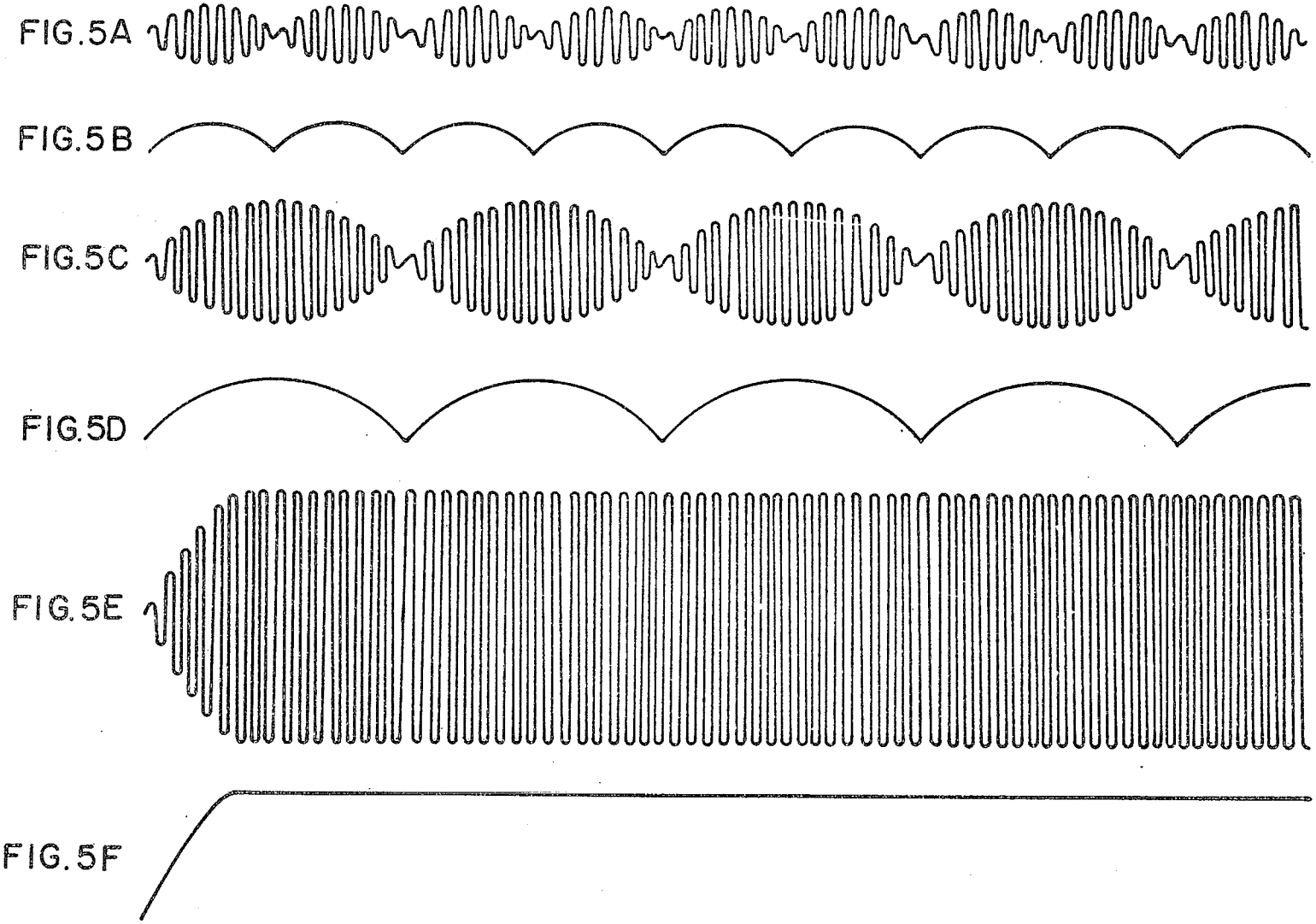
FIGS. 5A through 5F are wave shape relationship diagrams which are helpful in the understanding of FIG. 2.

FIGS. 5A and 5B illustrate the signal output of the crystal 88 and the diodes 92 respectively when the vehicle is traveling at a given rate of speed, for example 10 miles per hour. It is seen that the rate at which phase reversals are sensed as shown in FIG. 5A of the signal output of the crystal is relatively high and accordingly the signal output from the detector as shown in FIG. 5B is at a relatively low level since the crystal 88 has had insufficient time to reach the 63% level to provide a maximum signal output, since at each phase reversal the signal output from the crystal 88 returns to zero, and accordingly the capacitor 94 does not charge to the threshold level of the level detector 96. When the vehicle is traveling at a lower speed for example 5 miles per hour the signal outputs from the crystal 88 and diode 92 are illustrated by FIGS. 5C and 5D, respectively. It is seen that the rate of phase reversals of the signal output from the crystal is lower due to the increased time between sensed phase reversals and accordingly a higher amplitude signal appears at the output of the detector, however the capacitor 94 still does not charge to the threshold of the level detector 96. When the vehicle has reached the defined zero speed level, the crystal 88 has sufficient time to provide its maximum signal output since the time between sensed phase reversals is 1.25 seconds or longer. The signal outputs from the crystal 88 and the detector 92 are illustrated in FIGS. 5E and 5F respectively. The capacitor 94 therefore, has sufficient time to charge to the threshold level of the level detector 96, which in response thereto provides a direct current signal to the input terminal 98 of the AND gate 100 which is indicative of the vehicle being within the vehicle stopping area and having reached the defined zero speed. A rear right receiver 102, similar to the front right receiver 64, provides a direct current signal to the input terminal 104 of the AND gate 100 when the rear right receiver senses a zero speed condition in a like manner to the front right receiver. In response to the concurrent provision of the dc signals to the input terminals 98 and 104, a dc signal is provided at the output terminal 106 for application to a coil 108 of a relay 110 for energizing same. The relay is illustrated in a deenergized position. It is seen that when the relay is deenergized, as shown, a propulsion signal is provided from a current source 112 to propulsion equipment 118 by way of relay contacts 114 and 116 for maintaining tractive effort by the vehicle. A door controller 120 for the right side of the vehicle receives no energization potential at this time since the contact 122 of the relay 120 is receiving no operating potential at this time. When however the relay 110 is energized, as was previously explained, the contacts 114 and 122 are pulled up and the propulsion equipment 118 no longer is provided propulsion current and a positive +V is applied to the door controller 120 by way of relay contacts 122 and 124 for opening the doors on the right side of the vehicle. The relay contacts 116 and 124 may be the back contacts of a ralay on the left side of the vehicle which performs a function similar to that performed by the relay 110. This assures that the doors on both sides of the vehicles are not opened simultaneously, since the contacts 116 and 124 are shown in the deenergized position.

Figure 6:
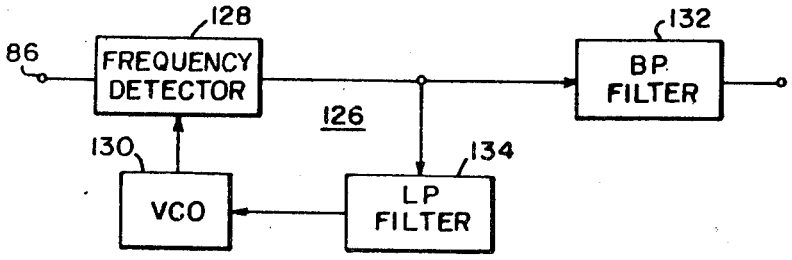
FIG. 6 is a frequency locked loop which may be used in the practice of the present invention.

The frequency selective and phase sensitive device employed in the receiving apparatus may take many different forms. For example, the crystal 88 and amplifier 90 may be replaced by another frequency selective and phase sensitive device such as the frequency locked loop 126 and bandpass filter 132 illustrated by FIG. 6. The signal output from the summation device 76 at the output terminal 86 is applied to a frequency detector 128 which has applied to a second input the output from a voltage controlled oscillator (VCO) 130. When the output from the voltage controlled oscillator and the signal input to the terminal 86 are locked on, that is the phase reversals of the input signal are occurring at the predetermined rate of every 1.25 seconds or longer (the designed response time of the frequency locked loop) the frequency of the signal output from the frequency detector 128 is substantially equal to the center frequency of the bandpass filter 132. In such instances, the signal output from the detector 92 is of sufficient amplitude to charge the capacitor 94 such that the level detector provides the proper signal output to the AND gate 100. Another filter such as a low pass filter 134 also is responsive to the output of the frequency detector 128 for providing signal input to the voltage controlled oscillator 130 such that the voltage controlled oscillator locks on to the proper frequency whenever the phase reversals are provided to the frequency detector at the proper rate. A detailed discussion of the operation and function of frequency locked loops are found in many published articles. One such discussion is set forth in "Signetics Linear Phase Locked Loops Application Books", Copyright 1972.

In summary a zero speed detection and door opening control system has been described which responds only to signal transmissions from the wayside at a vehicle stopping area for determining that the vehicle is within the vehicle stopping area and has reached a defined zero speed limit, such that selected doors on the vehicle may be safely opened.

What is claimed is:

1. In a control system for a vehicle operative with a vehicle stopping area, the combination of means operative with said vehicle stopping area for transmitting a signal having phase reversals, means operative with said vehicle for receiving said transmitted signal and sensing said phase reversals at a rate determined by the travel of said vehicle, and means operative with said signal receiving means for providing a control signal when the phase reversals are sensed at a rate in accordance with a defined zero speed of said vehicle.

2. The control system of claim 1, including means responsive to said control signal for controlling the operation of said vehicle.

3. The control system of claim 1, with said defined zero speed condition of said vehicle corresponding to a predetermined rate of said phase reversals.

4. In a control system for a vehicle operative with a vehicle stopping area, the combination of means for transmitting an oscillatory signal means operative with said signal transmitting means for providing phase changes of said signal related to physical positions along said vehicle stopping area, first means operative with said vehicle for providing a first signal in response to said phase changes at a rate proportional to the travel speed of said vehicle, second means operative with said vehicle for providing a second signal in response to said phase changes at a rate proportional to the travel speed of said vehicle, and means responsive to at least one of said first and secondd signals for providing a control signal when the phase changes of at least said one signal are at a rate less than a defined zero travel speed of said vehicle.

5. The control system of claim 4, including means responsive to said control signal for controlling the operation of said vehicle.

6. The control system of claim 4, with said defined zero speed being a speed condition of said vehicle for a predetermined period of time.

7. In a control system for a vehicle operative with a vehicle stopping area, the combination of signal transmitting means including a first antenna situated adjacent said vehicle stopping area for providing a transmitted signal having phase reversals at spaced increments along said first antenna;

at least a second antenna carried on said vehicle for coupling with said first antenna when said vehicle travels adjacent said vehicle stopping area and sensing the phase reversals of the transmitted signal at a rate proportional to the travel of said vehicle; and means responsive to the phase reversals of the transmitted signal received by said second antenna for providing a control signal when the phase reversals occur at a rate in accordance with a defined zero speed of the vehicle.

8. The control system of claim 7, with said control signal being provided when the speed of said vehicle is below said defined zero speed.

9. The control system of claim 7, including:

means for controlling the operation of said vehicle in response to the provision of said control signal.

10. The control system of claim 7 including:

propulsion means for driving said vehicle; and means for removing power from said propulsion means in response to the provision of said control signal.

11. In a control system for a vehicle operative with a vehicle stopping area, the combination comprising:

signal transmitting means, including a first antenna situated adjacent said vehicle stopping area, for providing a phase reversed transmitted signal at spaced increments along said first antenna;

at least second and third antennas carried on said vehicle for coupling with said first antenna when said vehicle travels adjacent said vehicle stopping area, said second and third antennas being separated by an increment different than the spaced increments along said first antenna, said second and third antennas sensing the phase reversals of the transmitted signal at a rate proportional to the travel speed of said vehicle;

means for comparing the signals received by said second and third antennas for providing a comparison signal having a frequency determined by the rate of the sensed phase reversals; and means responsive to the frequency of said comparison signal for providing a control signal when said frequency corresponds to a phase reversal rate in accordance with a defined zero speed of the vehicle.

12. The combination of claim 11 including:

means for opening at least one door on said vehicle in response to the provision of said control signal.

13. The combination of claim 11 including:

propulsion means for driving said vehicle; and means for removing power from said propulsion means in response to the provision of said control signal.

14. The combination of claim 11 including:

propulsion means for applying power to said vehicle; and means for removing power from said propulsion means in response to the provision of said control signal.

15. In a control system for a vehicle operative with a vehicle stopping area and including apparatus for opening at least one door on said vehicle, the combination comprising:

signal transmitting means including a first antenna situated along said vehicle stopping area, said first antenna having transpositions at fixed distances for reversing the phase of the transmitted signal at each transposition;

at least second and third antennas carried on said vehicle, which antennas couple with said first antenna for sensing the phase reversals of the transmitted signal at a rate determined by the rate of travel of said vehicle, said second and third antennas being separated by a distance different than the fixed distances along said first antenna;

means for shifting the phase of the signal sensed by said third antenna;

means for comparing the signal sensed by the second antenna and the phase shifted signal for providing a comparison signal;

frequency responsive means for providing a control signal in response to the frequency of said comparison signal as determined by the rate at which the phase reversals are sensed; and means responsive to the provision of said control signal for opening said one door on said vehicle.

16. The combination claimed in claim 15 including:

propulsion means for applying power to said vehicle; and said means responsive to the provision of said control signal including means for removing power from said propulsion means.

17. The combination claimed in claim 15 wherein said frequency responsive means comprises a narrow band crystal.

18. The combination claimed in claim 15 wherein said frequency responsive means comprises a frequency locked loop.

* * * * *